United States Patent [19]

Cochrane

[11] 4,032,029

[45] June 28, 1977

[54] TAMPER-PROOF BOTTLE CAP AND CONTAINER

[76] Inventor: Benjamin Arthur Cochrane, 181 Sonora Ave., Danville, Calif. 94526

[22] Filed: Apr. 5, 1976

[21] Appl. No.: 673,630

[52] U.S. Cl. ..... 215/256; 220/270

[51] Int. Cl.[2] ..... B65D 41/32

[58] Field of Search ..... 215/256, 253; 220/270, 220/265, 266, 276

[56] References Cited

UNITED STATES PATENTS

| | | | |
|---|---|---|---|
| 3,347,407 | 10/1967 | Coolidge | 220/270 |
| 3,595,420 | 7/1971 | Miskin | 215/256 |
| 3,672,528 | 6/1972 | Faulstich | 220/270 |
| 3,707,240 | 12/1972 | Wilson | 215/256 |
| 3,940,004 | 2/1976 | Faulstich | 215/256 |

FOREIGN PATENTS OR APPLICATIONS

| | | | |
|---|---|---|---|
| 220,972 | 4/1962 | Austria | 215/256 |
| 1,422,230 | 11/1964 | France | 215/256 |
| 1,265,477 | 3/1972 | United Kingdom | 215/256 |

*Primary Examiner*—Ro E. Hart
*Attorney, Agent, or Firm*—Michael D. Nelson

[57] ABSTRACT

An improved bottle cap particularly useful for returnable containers is disclosed. The cap is composed of a top disk, a thin-walled cylindrical outer skirt and a coaxial inner skirt. The outer skirt is weakened along two circumferential score lines which traverse the skirt in an arc of about 250° to 358° forming a weakened cylindrical band around most of the outer skirt. A narrow strip connecting the upper portion of the skirt to the lower portion is left between the incompleted arc. At least one vertical score line extends downwardly from the lower circumferential score line to the bottom edge of the outer skirt. A tab is attached to the cylindrical band to provide a means whereby a person may grasp the tab between the fingers and tear the band from the cap. Two circumferential beads traverse the inside of the outer skirt with one bead being disposed above the upper score line and one bead below it. When the band is removed, the upper portion of the cap may be removed and used as a reclosure cover. The lower portion is torn from the container by the connecting narrow strip thereby allowing the container to be recycled.

13 Claims, 10 Drawing Figures

TAMPER-PROOF BOTTLE CAP AND CONTAINER

BACKGROUND OF THE INVENTION

Plastic caps for plastic bottles are typically of the type disclosed in U.S. Pat. No. 3,338,446. The caps have a depending thin-walled skirt weakened approximately midway of its length with a circumferential score line so that the portion of the skirt below the score line may be torn off. The cap has two internal beads which extend circumferentially round the inside of the cap. These beads fit into grooves in the bottle neck and prevent the cap from being removed from the container. When both beads are in place the cap cannot be removed thereby preventing any tampering with the bottle contents. The lower bead is torn away when the lower skirt is removed. This then allows the cap to be easily pried over the upper bead to allow access to the contents. The upper bead remains with the cap thereby allowing the cap to be used repeatedly for reclosure until the contents of the bottle are exhausted.

There are several problems with the plastic caps of the prior art. A major problem is the splitting of the lower portion of the cap when it is forced onto the bottle neck. The score line for the tear-away lower section extends diagonally through the lower portion of the cap skirt and terminates at its rim. This score line weakens the cap rim and when pressure is exerted in an attempt to push the cap onto the bottle, the cap rim often tears along this score line. Bottles with torn rims must be removed from the packaging line, the cap manually removed and the bottle and contents recycled. This tearing problem, referred to as cap splitting, is a substantial burden and significantly increases operating expenses.

Another problem with the prior art caps is the difficulty by the consumer in tearing the lower skirt from the cap. The problem in caused, in part, by the manufacturer when it strengthens the score line for the purpose of reducing cap splitting as discussed supra. By strengthening the score line, the amount of force or difficulty required to tear the lower skirt from the cap is proportionately increased.

In addition, the score line as it extends diagonally through the lower skirt of the cap, must penetrate the lower bead which extends circumferentially around the inside of the skirt. Because the bead increases the thickness of the skirt at this point, the score line does not cut into the skirt as deeply thereby increasing the difficulty in tearing the lower skirt from the cap.

Another problem existant with the prior art caps is the loose fit of the cap onto the bottle neck. A tight fit between the cap and the bottle is essential for a good seal. Although the prior art caps could be made to fit more tightly onto the bottle, such an improvement would result in a greater number of cap splitting. Thus an improvement in fit or seal is off-set by an increase in split caps and operating costs.

Recently an improved tamper-proof cap was disclosed in U.S. Pat. No. 3,927,784 to the inventor herein which eliminated the cap splitting problems. In this cap a thin walled outer skirt was weakened along two circumferential score lines which formed a cylindrical band around the skirt below the first bead. When the band is removed, by way of a convenient tab, the lower skirt containing the lower bead is left on the container neck completely severed from the main cap portion. The upper or cap portion could then be conveniently used again and again as a cover until the container contents are consumed.

This cap while representing a significant improvement over the prior art, created other problems in certain applications. For example if a cap is defectively manufactured and is inadvertantly inserted onto a full container, the cap must be removed and the container recaped. The problem with the improved cap is that the lower portion of the skirt is difficult to remove from the container neck to accomodate recycling the container.

In addition, the improved cap cannot be used satisfactorily on returnable containers since the lower portion of the skirt is difficult to remove from the neck of the container.

A need thus exists for a tamper-proof cap which can be used repeatedly for reclosure, which can be inserted onto the bottles without cap splitting, which can be completely removed from the bottle without great difficulty, which has a tight fit or good seal and which is relatively easy to produce and inexpensive to manufacture.

It is therefore an object of this invention to provide an improved plastic cap.

It is an additional object of this invention to provide an improved plastic cap which does not split when inserted onto a container.

It is a further object of this invention to provide an improved plastic cap which may be completely removed from the container without difficulty.

Another object of this invention is to provide an improved plastic cap which fits tightly on the container neck and provides improved sealing of the container contents.

It is a further and additional object of this invention to provide a container and improved cap combination.

Other related and additional objects of this invention will be apparent from the drawing, the following description of the invention and appended claims.

SUMMARY OF THE INVENTION

Figure 1:
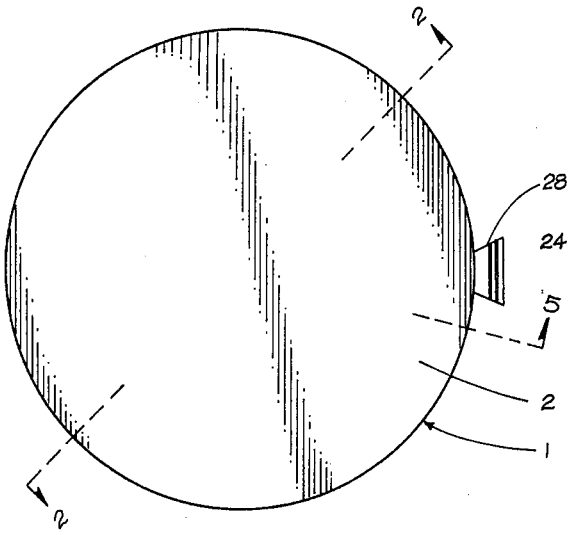
FIG. 1 is a top view of a cap in accordance with this invention.
Figure 2:
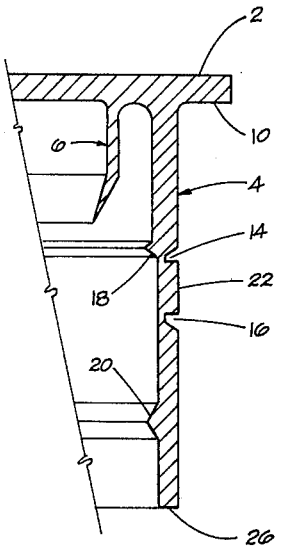
FIG. 2 is a sectional view of a cap taken substantially along line 2—2 of FIG. 1.
Figure 3:
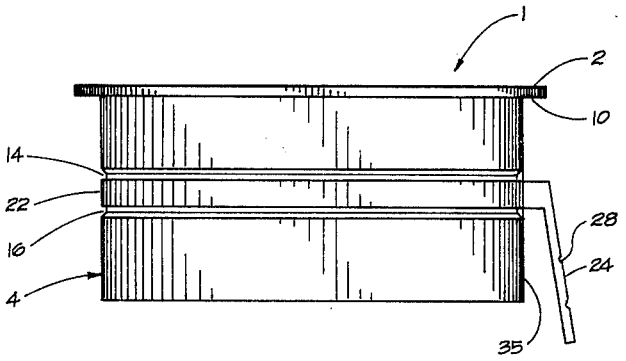
FIG. 3 is a side view of the cap showing the skirt.
Figure 4:
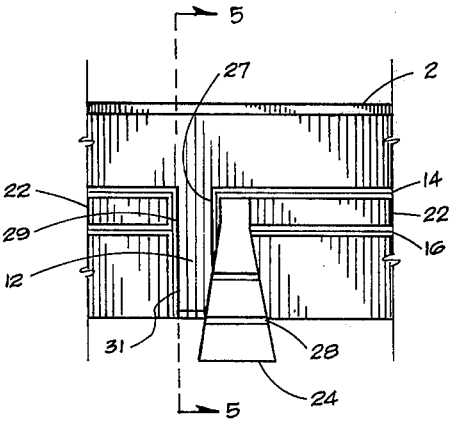
FIG. 4 is a fragmentary side view of a cap showing the connection of a tear tab to the skirt and the narrow connecting strip.
Figure 5:
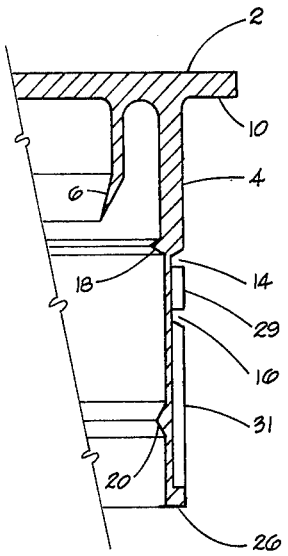
FIG. 5 is a cross-sectional view of the top taken along view lines 5—5 of FIG. 4.
Figure 6:
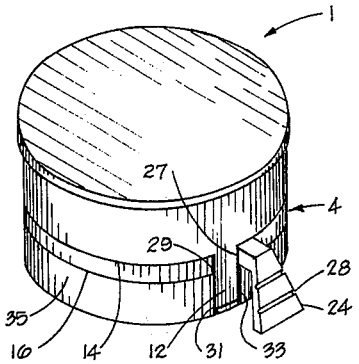
FIG. 6 is a perspective view of the cap.
Figure 7:
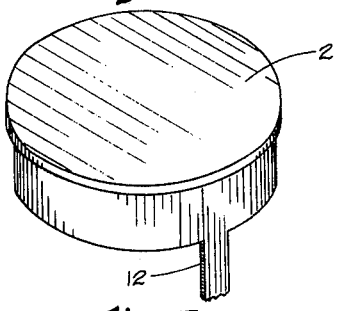
FIG. 7 is a perspective view of the top portion of the cap with the tear band and lower skirt removed.
Figure 8:
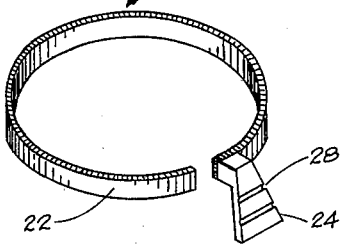
FIG. 8 is a perspective view of the tear band after its removal from the cap.
Figure 9:
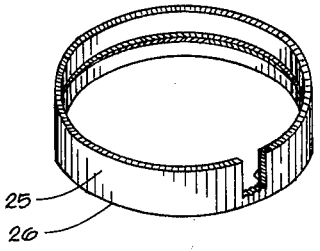
FIG. 9 is a perspective view of the lower skirt after its removal from its cap.
Figure 10:
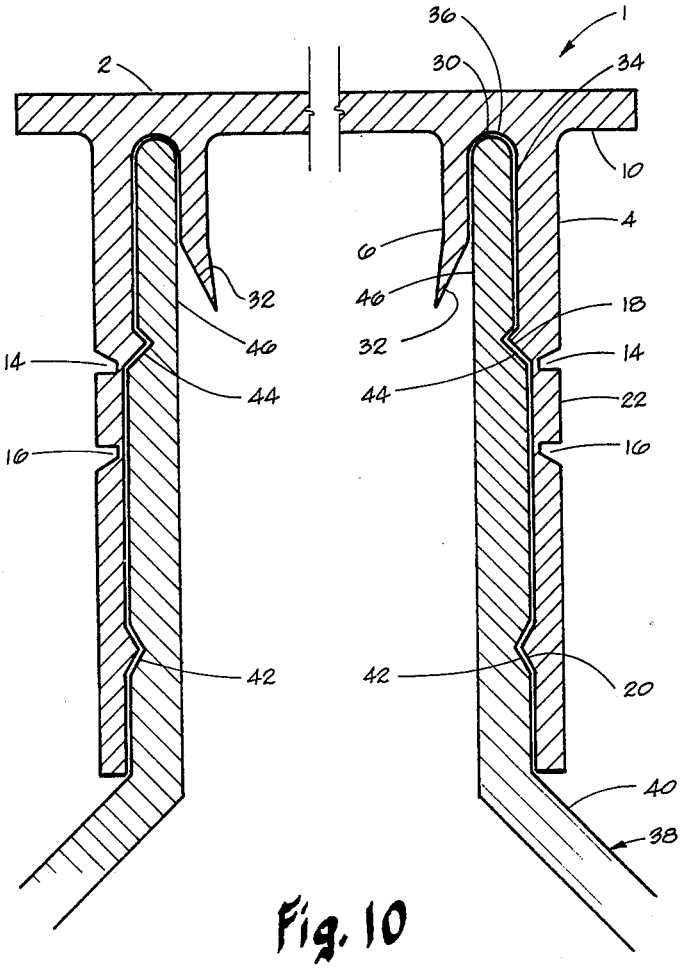
FIG. 10 is a cross-sectional view of the cap on an exemplary container neck.

The aforementioned objects and their attendant advantages can be realized by a deformable plastic cap comprising (1) a top disk, (2) a cylindrical thin-walled outer skirt extending substantially perpendicularly from said disk and (3) a cylindrical inner skirt substantially perpendicular to the disk enclosed within said outer skirt and substantially co-axial therewith. The outer skirt is scored and weakened along a circumferential first score line downwardly spaced from the disk. The disk is also scored along a circumferential second score line downwardly spaced from the first score line. The first and second score lines form a weakened cylindrical band traversing the outer skirt in an arc of about 250° to 358°. The incompleted arc leaves a narrow band between the ends of the cylindrical band which connects that portion of the outer skirt above its band to that portion of the outer skirt below the band. A tear tab is attached to one end of the cylindrical band and extends outwardly from the outer skirt and preferably downwardly from the cylindrical band. An area connecting the first and second score lines, adjacent the tear tab and the narrow strip, is weakened to allow easy tearing of the cylindrical band from the cap. A second weakened area is provided between the first and second score lines adjacent the opposite side of the narrow strip from the tear tab so that the cylindrical band may be completely removed. In order to hold the cap to the container neck, two narrow radial beads are provided which extend circumferentially around the inside of the outer skirt. One bead is positioned above the first score line and one bead is positioned below it, and preferably below the second score line. A third score line is provided which extends downwardly from the second score line to the lower portion of the outer skirt below the second band. This score line is provided so that the lower portion of the outer skirt may be torn from the container neck by the narrow strip. To remove the cap from a container, the consumer grasps the tear tab between his fingers and pulls outwardly. The cylindrical bands tears through the first weakened area and around the outer skirt along the first and second score lines. The band is completely removed by further tearing through the second weakened area. The cap can then be pried off by lifting upward. The lower portion of the outer skirt may be removed by pulling the reclosure cap portion outward. The skirt tears along the third score line to the bottom rim and is completely severed from the container neck thereby allowing the container to be recycled.

DETAILED DESCRIPTION OF THE INVENTION

When references are made to the accompanying drawings the similar characters of reference represent corresponding parts in each of the several views.

Cap 1 is constructed in accordance with the present invention from a resilient and moderately flexible plastic substance so that it will deform slightly to snap on and off of the container. Exemplary plastic materials which may be employed include polyethylene, polystyrene, polyvinyl, chloride, polyacrylates, polyamides, polypropylene, etc. The preferred plastics are polyethylene and polystyrene.

Cap 1 is comprised of three different sections, a top disk 2, an outer skirt 4 and an inner skirt 6. The top disk 2 is preferably a flat circular plate having a substantially planer exterior surface. This flat exterior surface provides a convenient place for labels or instructional material. It should be recognized that the disk can have a shape other than circular. For example the disk can be rectangular, oval, or other and can have a curved or other surface. In a preferred embodiment the disk is flat and circular and extends beyond the cylindrical outer skirt to form a circumferential lip 10 around the cap. This lip thereby provides a convenient means for facilitating the removal of the upper portion of the cap from the container. Thus, the consumer, after removing the tear band from the cap, can open the container by applying pressure upwardly on the lip 10 by the thumb or finger. This action will unseat the upper bead from the upper groove and allow the cap to slide off the container neck.

The outer skirt 4 of Cap 1 is integrally attached to the top disk 2 and extends substantially perpendicularly from the surface of the disk. The outer skirt 4 is a thin-walled cylindrical shell and is composed of the thin shell, an upper score line 14, a lower score line 16, tear tab 24, an upper circumferential bead 18 and a lower circumferential bead 20. The thickness of the skirt is not critical to the practice of this invention as long as the cap is sufficiently resilient to allow the internal beads 18 and 20 to expand over the wide areas of the container neck and snap into the container grooves without tearing of the cap or container. Generally, however, the skirt thickness is governed by economics with the thinnest functional cap being preferred. Usually the thin shell will have a thickness ranging from 0.3 millimeters (mm) to 1.5 millimeters and more usually from 0.5 mm to 1 mm.

The upper score line 14 extends circumferentially around the skirt 4 in an arc of about 250° to 358°, preferably from 300° to 355 ° and more preferably from 340° to 355° forming a circular weakened line enclosing most of the skirt. The score line 14 may be made on either the inner or outer surface of the skirt.

The lower score line 16 is substantially the same as the upper score line except that it is disposed at a lower position around the skirt. Like the upper score line, the lower score line may be made on either the inner or outer surface of the skirt and extends in an arc of about 250° to 358°, preferably from 300° to 355° and more preferably from 340° to 355°.

The portion of the outer skirt between score line 14 and score line 16 is the cylindrical tear band 22. This band is removed when the consumer wishes to open the container and after it is removed from the cap it is the cylindrical or tear band 22 traverses the outer skirt in an arc from about 250° to 358°, preferably from 300° to 355° and more preferably from 340° to 355°. Because the cylindrical band does not completely encompass the outer skirt, it leaves a narrow strip 12 connecting the portion of the outer skirt above the cylindrical band with the portion of the outer skirt below the band. In width, the cylindrical band will generally range from 2 mm to 10 mm, preferably from 3 to 6 mm.

A tear tab is attached to the cylindrical band 22 and provides a means for the cylindrical band to be torn from the cap by the consumer. The tear tab 24 may be any projecting tab which allows the consumer to easily grasp the tab by the fingers. In a preferred embodiment, the tab 24 extends outwardly from the cylindrical band 22 and then downwardly. The tab 24 may extend below the rim 26 of the outer skirt. By extending the tab below the rim of the skirt, the tab may be used as a guide in automatic capping machines to guide the cap within the machine and onto the container. Alternatively, a small rounded projection may extend downwardly from the rim for this purpose. In order to increase the friction between the fingers and tear tab, the tab is preferably grooved with serrates 28 or the like.

A first weakened area 27 extends from the lower score line 16 to the upper score line 14 substantially adjacent and between tear tab 24 and narrow strip 12. The weakened area is provided so that the cylindrical band may be torn from the narrow strip. The weakened area 27 may be a gap in the band or may be a simple score line extending vertically between the two circumferential score lines 16 and 14.

A second weakened area 29 extends from the upper score line 14 to the lower score line 16 between the narrow strip 12 and the opposite end of cylindrical band 22 from tab 24. This weakened area is provided so that the cylindrical band may be completely severed from the outer skirt. The weakened area may be a gap in the band of it may be a simple score line as shown in the drawing.

Upper and lower internal circumferential beads are provided around the interior of the outer skirt which fit into grooves in the container neck and hold the cap firmly onto the container. The upper bead 18 is disposed above the first score line between the score line 14 and the top disk 2. The lower bead 20 is disposed below the first and preferably below the second score line between the score line 16 and the rim 26. The beads 18 and 20 are substantially uniform raised surfaces projecting radially inwardly from the skirt. In one embodiment, the raised surface has a semi-circular cross-section; in another it may be triangular. In another embodiment, the raised surface may extend substantially horizonally at its upper area and curve downwardly and outwardly to the skirt at its lower area. The type, shape and size of the beads can be the same as the beads discussed in the U.S. Pat. Nos. 3,338,446 and 3,672,528, which patents are herein incorporated by reference.

To facilitate the removal of the lower portion 35 of outer skirt 4 from the container neck, a third 31 and a fourth 33 score lines are provided which extend downwardly from the lower score line 16 to the lower portion 26 of the outer skirt 4 and terminate below lower bead 20. The third and fourth score lines are illustrated as being disposed on each side of the narrow strip 12. The third and fourth score lines (31 and 33) preferably terminate immediately above rim 26 so as to minimize cap splitting. Preferably the score lines terminate from 0.1 to 2 mm. and more preferably from 0.2 to 1 mm. from the cap rim. It is recognized that the third and fourth score lines may in a less preferred embodiment actually terminate at the rim 26 of the outer skirt. In another embodiment of this invention, not specifically illustrated by the drawings, only one score line extends downwardly from the lower circumferential score line 16. The score lines 31 and 33 may be made on either the inner or outer surface of the skirt, however, if these score lines are on the outside surface, and the second bead below the lower score line, then gaps in the bead should be provided to facilitate easy removal of the lower portion 35 from its container neck. If the score lines are on the inner surface they may simply cut through the bead.

The inner skirt 6 of cap 1 is integrally attached to the top disk 2 inward from the outer disk and extends substantially perpendicular to the planner surface of the disk. The inner skirt 6 is disposed inward and enclosed within the chamber of the outer skirt and substantially co-axial therewith. The inner skirt 6 preferably extends for a distance shorter than the outer skirt and preferably terminates before the first score line 14. More preferably the inner skirt 6 terminates adjacent to or before the upper bead 18. The inner skirt 6 and the outer skirt 4 form an annular chamber 37 in which the container neck is held. The inner skirt is disposed so that it tightly fits into the opening of the container neck, and the outer skirt is disposed so that it tightly fits along the outside of the container neck. The annular chamber 34 is preferably shaped at its top with rounded interior surface 36 to provide a seal with the rounded exterior surface 30 of the container neck lip. The terminus of the inner skirt 6 is preferably slanted inward such as by inwardly curving exterior surface 32. Terminating the inner skirt in this manner allows the inner skirt to guide the lip of the container neck into the annular chamber 34.

The caps are conveniently prepared by an injection mold technique. Although the injection mold is by far the most convenient, it is recognized that other methods for making the cap can be used.

The cap 1 is primarily for use with a thin-walled plastic container 38. The container is usually fairly strong and lightweight. Although the walls are reasonably rigid, there is generally sufficient resiliency in the plastic materials so that they will flex slightly under pressure.

The shape of the lower portion of the container 38 is subject to considerable variation as is well understood in the plastic bottle art. Neck 40 projects upwardly from the main portion of the container. Neck 40 is an elongated upwardly-inwardly shaped cylindrical thin-walled shell. At the upper end of neck 40 are two peripherally disposed circumferential grooves 42 and 44. A cylindrical neck 46 extends up from the upper groove 44 and terminates, in a preferred embodiment, in a smooth rounded container lip 30. The upper groove 44 is disposed so that it encounters bead 18 of cap 1 when the cap is inserted onto the container. The lower groove 42 is disposed so that it encounters bead 20 of cap 1 when the cap is inserted onto the container. The circumferential grooves may be of triangular, circular, rectangular or other cross-section and are preferably of the same cross-section as the cap beads. The type, size and shape of the container can be as shown and described in U.S. Pat. No. 3,338,446.

In using the cap and the combination of this invention, after the container 38 has been filled with a product, the cap 1 is installed. Automatic machinery may be used for this purpose. Outer skirt 4 is slipped on outside cylindrical neck 46 and a downward pressure is applied. The top rim of the container neck encounters slanted surface 32 which guides the lip 30 between skirts 4 and 6. As the downward pressure is continued, the beads 18 and 20 slide over the surface of neck 38 and snap into grooves 42 and 44. The flexible nature of the plastic material of which the cap is fabricated, permits this temporary deformation of the parts. Thus assembled, the container is sealed since the cylindrical container neck 46 is held tightly between skirts 4 and 6 and the rounded lip 30 is contacted by the rounded interior surface 36 of the cap. It is nearly impossible to remove the cap 1 while skirt 4 is intact.

When the consumer wishes to open the container, he grips the tear tab 24 and pulls outwardly tearing cylindrical band 22 from the outer skirt 4. The lower portion of the outer skirt remains on the container connected thereto only by narrow strip 12. The portion of the cap above the cylindrical band comprises a reclosure cover for the container 38. Such cover may be pried off by lifting on lip 10. This operation is possible where there is only a single bead 18 in position in groove 40. When skirt 4 is intact before the cylindrical band is removed, it is almost impossible for a consumer to dislodge both bead 18 and bead 20. The cover portion of cap 1 may be replaced by pushing downwardly on disk 2. The bead 18 then snaps into groove 44 and the cap is again positioned. The closure may be performed as many times as desired.

The lower portion 35 of the outer skirt may be torn from the container neck by pulling outwardly on the reclosure cover portion of the cap. As the reclosure cover is pulled, the third and fourth score lines tear and as the outward force continues the lower portion is severed from the container. The lower portion 35 may also be severed from the narrow strip by grasping each portion and pulling in opposite directions. The lower portion 35 will snap from the narrow strip and the reclosure cover.

Although the foregoing invention has been described in some detail, by way of illustration and example, for purposes of clarity and understanding, it is understood that certain changes and modifications may be practiced within the spirit of the invention and such are within the scope of the invention as defined by the appended claims.

I claim:

1. A deformable plastic cap comprising (1) a top disk, (2) a cylindrical thin-walled outer skirt extending substantially perpendicularly from said disk, and (3) a cylindrical inner skirt extending substantially perpendicularly from said disk enclosed within said outer skirt and substantially coaxial therewith;

said outer skirt scored along a circumferential first score line below said disk and scored along a circumferential second score line downwardly spaced from said first score line, said first and said second score lines forming (a) a weakened cylindrical band traversing said outer skirt in an arc from about 250° to about 358° and (b) a narrow strip between the ends of said cylindrical band from the incompleted arc;

a tab attached to one end of and extending outwardly from said cylindrical band;

a first weakened area extending from said first score line to said second score line between said narrow strip and said tab;

a second weakened area extending from said first score line to said second score line between said narrow strip and the opposite end of said cylindrical band from said tab;

a narrow circumferential first bead around the inside of said outer skirt between said first score line and said disk;

a narrow circumferential second bead around the inside of said outer skirt below said first score line; and a third score line extending downwardly from said second score line to a lower portion of said outer skirt below said second bead.

2. The deformable cap defined in claim 1 wherein said third score line extends downwardly from said second score line to the lower portion of said outer skirt adjacent said narrow strip and wherein a forth score line extends downwardly from said second score line to the lower portion of said outer skirt below said second bead on the opposite side of said narrow strip from said third score line.

3. The deformable cap defined in claim 1 wherein said third score line extends to the bottom of said outer skirt.

4. The deformable cap defined in claim 2 wherein said second bead is below said second score line.

5. The deformable cap defined in claim 4 wherein said first bead and said second bead have a semi-circular cross-sectional area.

6. The deformable cap defined in claim 4 wherein said top disk has a flat circular lip extending outwardly from said outer skirt.

7. The deformable cap defined in claim 4 wherein said cap is made of polyethylene or polystyrene.

8. The deformable cap defined in claim 4 wherein said weakened areas are score lines connecting said first score line with said second score line.

9. The deformable cap defined in claim 4 wherein said first score line and said second score line are made along the outside of said outer skirt.

10. The deformable cap defined in claim 9 wherein said third and said forth score lines are made along the outside of said outer skirt and at least one gap is provided through said second bead adjacent said third score line and said forth score line.

11. The deformable cap defined in claim 4 wherein said third and said forth score lines are along the inside of said outer skirt and extend through said second bead.

12. The deformable cap defined in claim 4 wherein said third and said forth score lines extend to the bottom of said outer skirt.

13. In combination (1) a container with a cylindrical neck having an opening through said neck to said container, said neck having a circumferential upper groove on the outside thereof and a circumferential lower groove on the outside of said neck spaced downward from said upper groove, and (2) a deformable plastic cap comprising a top disk, a cylindrical thin-walled outer skirt extending substantially perpendicularly from said disk, and a cylindrical inner skirt extending substantially perpendicularly from said disk enclosed within said outer skirt and substantially coaxial therewith and having a diameter sufficient to fit within the opening of said container neck;

said outer skirt having a diameter sufficient to fit around the exterior of said container neck and scored along a circumferential first score line below said disk and scored along a circumferential second score line downwardly spaced from said first score line, said first and said second score lines forming (i) a weakened cylindrical band traversing said outer skirt in an arc from about 250° to about 358° and (ii) a narrow strip between the ends of said cylindrical band from the incompleted arc;

a tab attached to one end of and extending outwardly from said cylindrical band;

a first weakened area extending from said first score line to said second score line between said narrow strip and said tab;

a second weakened area extending from said first score line to said second score line between said narrow strip and the opposite end of said cylindrical band from said tab;

a narrow circumferential first bead around the inside of said outer skirt between said first score line and said disk and spaced so as to fit into said upper groove;

a narrow circumferential second bead around the inside of said outer skirt below said second score line and spaced so as to fit into said lower groove; and a third and a forth score lines extending from said second score line to the lower portion of said outer skirt below said second bead on opposite sides of said narrow strip.

* * * * *